US006854276B1

(12) United States Patent
Yuan et al.

(10) Patent No.: US 6,854,276 B1
(45) Date of Patent: Feb. 15, 2005

(54) METHOD AND APPARATUS OF CRYOGENIC COOLING FOR HIGH TEMPERATURE SUPERCONDUCTOR DEVICES

(75) Inventors: Xing Yuan, Albany, NY (US); Susumu Mine, Schenectady, NY (US)

(73) Assignee: SuperPower, Inc

( * ) Notice: Subject to any disclaimer, the term of this patent is extended or adjusted under 35 U.S.C. 154(b) by 0 days.

(21) Appl. No.: 10/465,089

(22) Filed: Jun. 19, 2003

(51) Int. Cl.[7] ..... F25B 19/00; F17C 7/04
(52) U.S. Cl. ..... 62/51.1; 62/45.1; 62/259.2
(58) Field of Search ..... 62/51.1, 45.1, 62/259.2

(56) References Cited

U.S. PATENT DOCUMENTS

| | | | | | |
|---|---|---|---|---|---|
| 3,374,641 | A | * | 3/1968 | Corvino et al. | 62/45.1 |
| 3,518,591 | A | * | 6/1970 | Zar | 335/216 |
| 3,588,312 | A | * | 6/1971 | Burnier | 174/15.4 |
| 4,432,216 | A | * | 2/1984 | Matsuda et al. | 62/51.1 |
| 5,150,578 | A | * | 9/1992 | Oota et al. | 62/47.1 |
| 5,220,800 | A | * | 6/1993 | Muller et al. | 62/51.1 |
| 5,293,750 | A | * | 3/1994 | Tamura et al. | 62/47.1 |
| 5,450,266 | A | | 9/1995 | Downie | |
| 5,477,693 | A | | 12/1995 | Morita | |
| 5,661,980 | A | * | 9/1997 | Gallivan | 62/51.1 |
| 5,749,243 | A | | 5/1998 | Lester | |
| 5,956,957 | A | * | 9/1999 | Lowry et al. | 62/51.1 |
| 6,501,970 | B2 | * | 12/2002 | Heise et al. | 505/163 |
| 6,629,426 | B2 | * | 10/2003 | Paul et al. | 62/259.2 |
| 2003/0021074 | A1 | | 1/2003 | Yuan | |

OTHER PUBLICATIONS

Eddie Leung, "Surge Protection for Power Grids," IEEE Spetrum, Jul. 1997, pp 26–30 vol. 34 No. 7, IEEE, New York USA.

M David Burghardt, "Engineering Thermodynamics With Applications," 2nd Edition, 1982, p. 63, Harper and Row, New York.

Jefferies and K.N. Mathes, "Dielectric Loss and Voltage Breakdown in Liquid Nitrogen and Hydrogen," IEEE Spectrum, 1970, pp. 83–91, vol. EI–5, IEEE, New York USA.

* cited by examiner

*Primary Examiner*—William C. Doerrler
(74) *Attorney, Agent, or Firm*—George L. Rideout, Jr., Esq.; Enrique Abarca, Esq.

(57) ABSTRACT

A method and apparatus for providing cryogenic cooling to HTS devices, in particular those that are used in high-voltage electric power applications. The method involves pressurizing liquid cryogen to above one atmospheric pressure to improve its dielectric strength, while sub-cooling the liquid cryogen to below its saturation temperature in order to improve the performance of the HTS components of the device. An apparatus utilizing such a cooling method consists of a vessel that contains a pressurized gaseous cryogen region and a sub-cooled liquid cryogen bath, a liquid cryogen heating coupled with a gaseous cryogen venting scheme to maintain the pressure of the cryogen to a value in a range that corresponds to optimum dielectric strength of the liquid cryogen, and a cooling system that maintains the liquid cryogen at a temperature below its boiling point to improve the performance of HTS materials used in the device.

26 Claims, 5 Drawing Sheets

METHOD AND APPARATUS OF CRYOGENIC COOLING FOR HIGH TEMPERATURE SUPERCONDUCTOR DEVICES

The U.S. Government has a paid-up license in this invention and the right in limited circumstances to require the patent owner to license others on reasonable terms as provided for by the terms of Contract No. DE-FC36-03G013033 awarded by the Department of Energy.

BACKGROUND

The invention relates generally to a cryogenic cooling system for high temperature superconductor (HTS) devices and more particularly to a cryogenic cooling system for FITS devices having high-voltage electric power applications.

There exists HTS cooling systems that use the properties of liquid nitrogen to achieve cryogenic cooling. Normally, liquid nitrogen is used at one atmospheric pressure (0.1 MPa) where its operating temperature (boiling point) is at 77 degrees Kelvin. However, since the critical current density of HTS materials improves significantly at temperatures lower than 77K, methods have been developed to reduce the temperature of the liquid nitrogen by manipulating its operating environment. FIG. 1 is a p(pressure)–T(temperature) diagram showing the relationship amongst the p, T and the three phases (solid, liquid and vapor/gas) of a typical substance. For nitrogen, the "Triple Point" is about 63.15K at 12.53 kPa. This shows by reducing the pressure of liquid nitrogen its boiling point temperature can be lowered to about 63K below which solid nitrogen would form. One example of using such properties of liquid nitrogen to achieve lower operating temperature is provided in U.S. Pat. No. 5,477,693. It describes a method of using vacuum pump to pump the gaseous nitrogen region in a cryogen containment vessel (cryostat) that contains both the liquid and gaseous nitrogen. Pumping reduces the pressure of the liquid nitrogen bath therefore reducing its temperature (boiling point) to below 77K. The performance of the superconductor, namely its critical current level, is then significantly improved.

Even though the prior art increases the performance of HTS materials by lowering the boiling temperature of liquid nitrogen through lowering its pressure, it is at the expense of significantly degrading the dielectric strength of liquid nitrogen and, as a consequence, such cooling systems are not suitable for high-voltage HTS applications. Typically, liquid cryogen based cooling systems for high-voltage HTS devices rely in large degree on the dielectric properties of the liquid cryogen as the main electrical insulation medium. There are two major factors that influence the dielectric properties of liquid nitrogen. One is the intrinsic dielectric strength of liquid nitrogen that is pressure dependent. FIG. 2 shows the dielectric strength of liquid nitrogen as a function of pressure. The strength decreases sharply when the pressure is below one atmospheric pressure (0.1 MPa) while the optimum value resides in the range of between 0.3 MPa and 0.5 MPa. The other major factor is the bubbles that occur in the liquid nitrogen. Bubbles, especially large size bubbles, tend to reduce the dielectric strength of liquid nitrogen. Bubbles will be generated when objects submerged in liquid nitrogen are heated to above the boiling temperature of liquid nitrogen. Lowering the boiling point in liquid nitrogen will thus make bubble generation more easily. Therefore the method of lowering liquid nitrogen temperature by lowering its pressure will have a negative impact on both factors that govern the dielectric strength of liquid nitrogen. Cooling systems based on such and similar approaches are therefore ill suited for high-voltage HTS applications.

BRIEF DESCRIPTION

Briefly, in accordance with the present invention, a method is provided for designing a liquid-cryogen-based cryogenic cooling system for HTS devices that have the characteristics of lower operating temperature of liquid cryogen to improve the critical current density of HTS materials while at the same time substantially increasing the dielectric strength of the liquid cryogen, making such a cryogenic cooling system suitable for high-voltage applications. Such a method comprises the steps of maintaining a pressurized cryogen within the cryogen containment vessel that contains both liquid and gaseous regions of the cryogen. It further includes steps of maintaining the temperature of a portion or all of the liquid cryogen at and below its boiling temperature and within its sub-cooled temperature range using cryocooling means.

Applying such methodology, in accordance with one embodiment of the present invention, there is provided a cyrogenic cooling system having an inner vessel, at least one HTS element, and an outer vessel. The space between the outer and inner vessel is maintained under a vacuum and multi-layer insulation (MLI) material is used to surround the inner vessel to provide it with thermal insulation to the radiation heat load. The inner vessel is housed inside the outer vessel and stores liquid cryogen. Above the liquid cryogen region there is a gaseous region of the cryogen and is pressurized above one absolute atomospheric pressure. Liquid heating and gas venting means are in place to control and maintain the pressure within the inner vessel. To address the high-voltage insulation issue of this cryogenic cooling system, a bucket or similar configuration made of dielectric materials is employed surrounding the HTS and throughout cryostat to ensure adequate high-voltage insulation. In addition, screens with small mesh sizes are deployed throughout liquid cryogen regions to breakdown large-size bubbles generated during device operation. Another feature of this cryogenic cooling system is a thermal transfer plate that is disposed inside the inner vessel around the circumference to divide the liquid cryogen into two regions. The region below the plate is sub-cooled to a temperature that improves the performance of HTS. The region above the plate is a buffer region where a temperature transition occurs between the boundary of the liquid and gas regions and the boundary of the buffer region and the sub-cooled liquid region. The thermal transfer plate also couples the heat from both the temperature transition buffer region and the sub-cooled region to a cooling means such as a cryogenic refrigerator (cryocooler). The cryocooler is employed to maintain the temperature of the region below the plate to within the range of the sub-cooled liquid temperature range, from the boiling temperature at the pressure, to the triple point temperature of the liquid cryogen.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
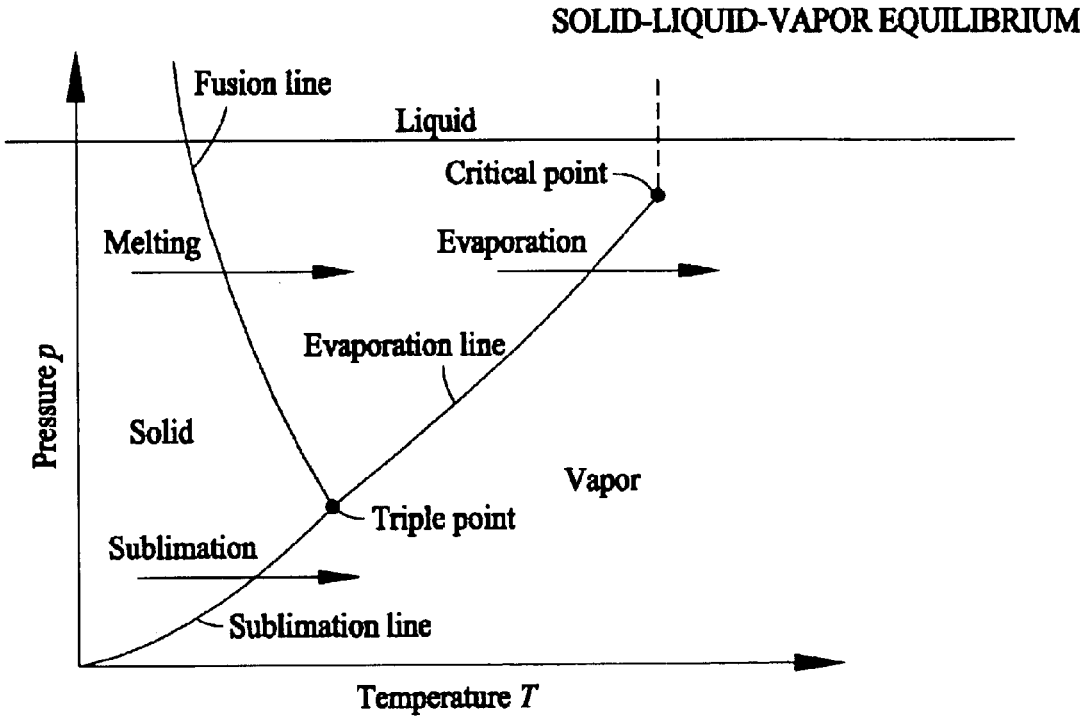
FIG. 1 is a typical p-T diagram showing phase changes of a substance under various pressure and temperature regimes.

The present invention generally relates to a cryogenic cooling systems for HTS device that have high-voltage applications even though it can also be applied to HTS devices that have other general purposes. The method of providing such a cryogenic cooling system includes maintaining a pressurized cryogen region that comprises a liquid as well as gaseous region, to above one absolute atmospheric pressure. The method further involves maintaining temperature of part or all of the liquid cryogen regions to below its boiling temperature (sub-cooled) using cooling means such as a cryogenic refrigerator (cryocooler).

Briefly, in accordance with the present invention, a method is provided for designing a liquid-cryogen-based cryogenic cooling system for HTS devices that have the characteristics of lower operating temperature of liquid cryogen to improve the critical current density of HTS materials while at the same time substantially increasing the dielectric strength of the liquid cryogen, making such a cryogenic cooling system suitable for high-voltage applications. Such a method comprises the steps of maintaining a pressurized cryogen within the cryogen containment vessel that contains both liquid and gaseous regions of the cryogen. It further includes steps of maintaining the temperature of a portion or all of the liquid cryogen at and below its boiling temperature and within its sub-cooled temperature range using cryocooling means.

Applying such methodology, in accordance with one embodiment of the present invention, there is provided a cyrogenic cooling system having an inner vessel, at least one HTS element, and an outer vessel. The space between the outer and inner vessel is maintained under a vacuum and multi-layer insulation (MLI), the material is used to surround the inner vessel to provide it with thermal insulation to the radiation heat load. The inner vessel is housed inside the outer vessel and stores liquid cryogen. Above the liquid cryogen region there is a gaseous region of the cryogen and is pressurized above one absolute atmospheric pressure. Liquid heating and gas venting means are in place to control and maintain the pressure within the inner vessel. Heating boils liquid cryogen and evaporates to gaseous space thus increasing the pressure. Venting releases gaseous cryogen to the outside atmosphere thus reducing the pressure within the vessel. Such heating and venting process can be controlled by an automated monitoring and feedback system. As discussed earlier, bubbles, especially large size bubbles, tend to degrade the dielectric strength of liquid cryogen. Bubbles can be generated when objects submerged in liquid cryogen get heated to above its boiling temperature. Pressurization raises the boiling temperature of the liquid cryogen. Raised boiling point will make bubble generation more difficult thus improving the dielectric properties of the liquid cryogen. To further address the high-voltage insulation issue of this cryogenic cooling system, a bucket or similar configuration made of dielectric materials can be employed surrounding the HTS and throughout cryostat to ensure adequate high-voltage insulation. In addition, screens with small mesh sizes can be deployed throughout liquid cryogen regions to breakdown large-size bubbles if they were generated during device operation. Another feature of this cryogenic cooling system is a thermal transfer plate that is disposed inside the inner vessel around the circumference to divide the liquid cryogen into two regions. The region below the plate is sub-cooled to a temperature that improves the performance of HTS. The region above the plate is a buffer region where a temperature transition occurs between the boundary of the liquid and gas regions and the boundary of the buffer region and the sub-cooled liquid region. The thermal transfer plate also couples the heat from both the temperature transition buffer region and the sub-cooled region to a cooling means such as a cryogenic refrigerator (cryocooler). The cryocooler is employed to maintain the temperature of the region below the plate to within the range of the sub-cooled liquid temperature range, from the boiling temperature at the pressure, to the triple point temperature of the liquid cryogen. If the liquid cryogen is sub-cooled to below its triple point temperature, solid cryogen will begin to form which may or may not be a desired result. In the case when sub-cooling is achieved through the use of a cryocooler, such a practice is not desired since at or below the triple point temperature, solid cryogen will form around the interface to the cryocooler and significantly degrade the cooling performance of the cryocooler.

Figure 3:
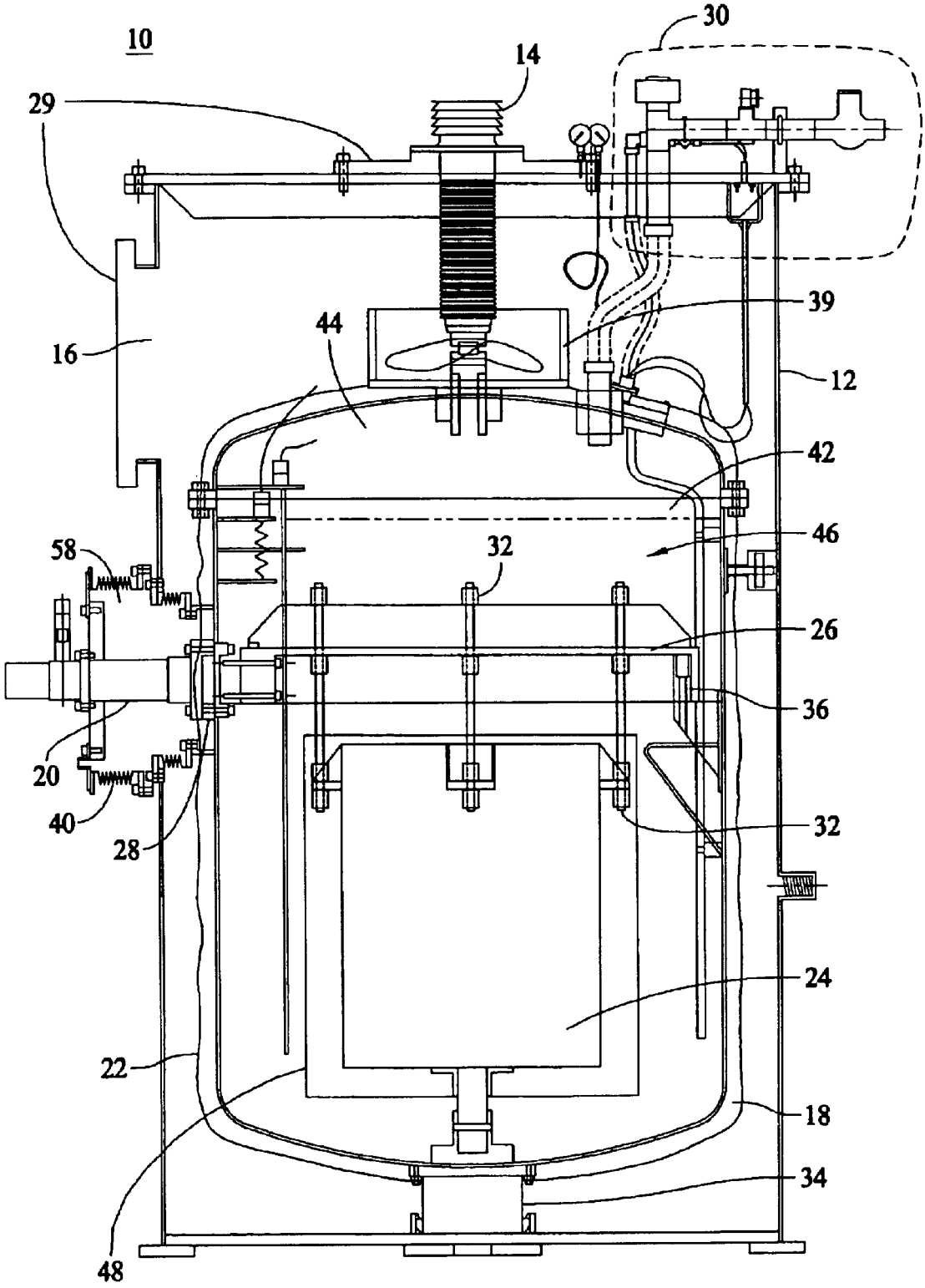
FIG. 3 is an illustration of one embodiment of the cryogenic cooling system of the present invention.
Figure 4:
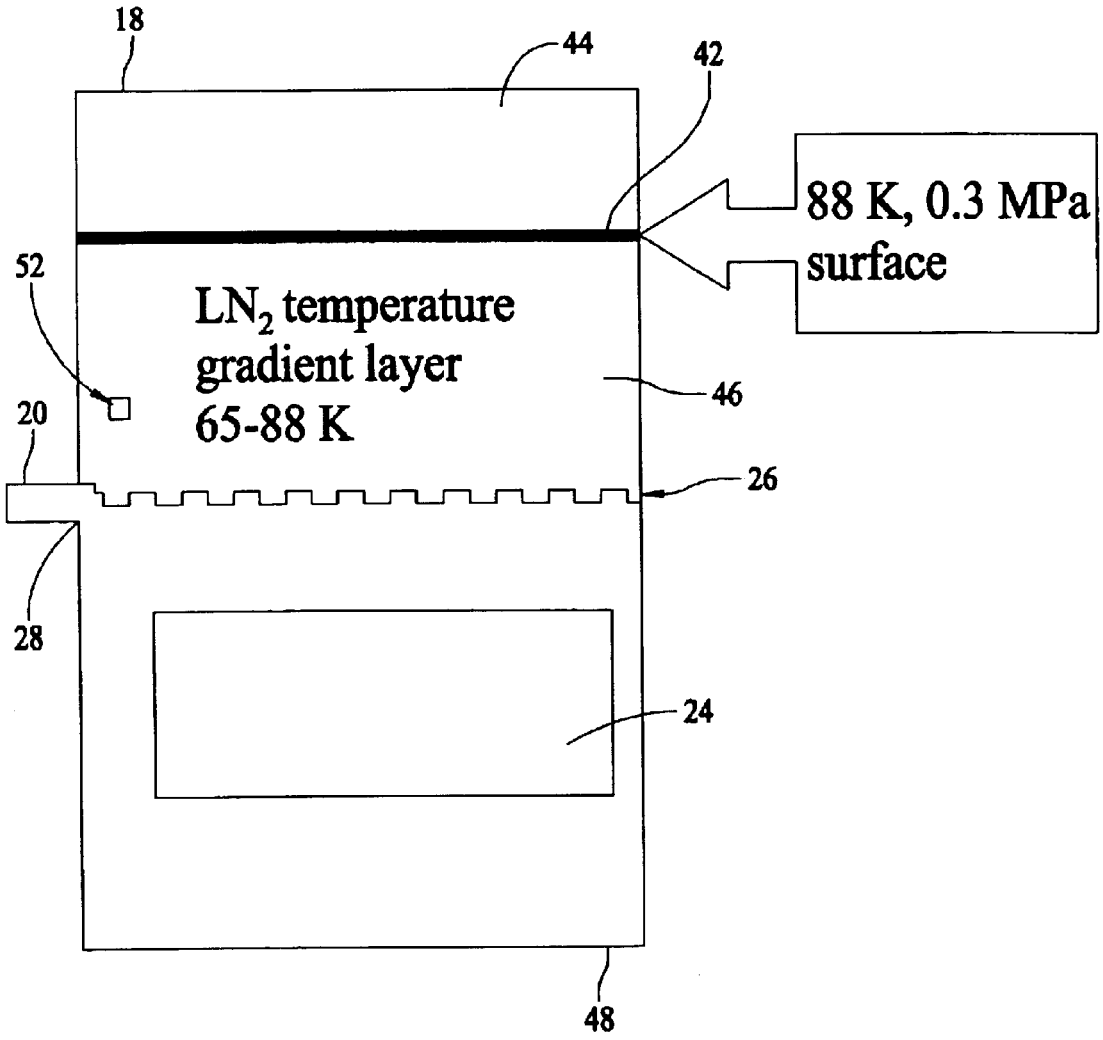
FIG. 4 is a schematic diagram of the states of the cryogen used in one embodiment of the cryogenic cooling system of the present invention.

One embodiment of the apparatus of present invention is illustrated in FIG. 3. A cryogenic cooling system 10 of the present invention comprises an outer containment vessel 12, an inner containment vessel 18 adapted to be contained inside the outer vessel 12, a venting port 30 pneumatically coupled to the inner vessel, a high-voltage bushing 14 electrically and mechanically coupled to the inner vessel 18, and a cryocooler 20 that is thermally and mechanically coupled to the inner vessel. The high-voltage bushing 14 can be used to supply electric current to HTS 24 and is connected to the outside high-voltage power sources such as an electric power grid. HTS 24 is coupled to a HTS support 32, which in turn is coupled to a thermal transfer medium 26. A copper ring 36 is mounted along the circumference of the inner vessel and is securely affixed to a thermal transfer medium 26. An inner vessel support 34 is coupled to the inner vessel 18. HTS 24 may also be the HTS assembly of a matrix fault current limiter (MFCL) as described by US patent application 2003/0021074A1, assigned to the assignee of the present invention and herein incorporated by reference.

The space between the outer 12 and inner 18 vessel is maintained under vacuum and multi-layer insulation (MLI) material 22 is used to surround the inner vessel 18 to provide it with thermal insulation to the radiation heat load.

An inner vessel venting port 30 provides gas-venting means for inner vessel 18 to reduce the gas pressure in inner vessel 18. Additionally, an auxiliary gas evaporation heater 52 may be employed to heat and boil liquid cryogen to increase the pressure of the inner vessel 18. These two aspects of the cryostat form the basis of the pressure control mechanism of the present invention in achieving an optimal pressure level of inner vessel 18, as is further described herein.

The size of the inner vessel 18 can be determined to provide adequate cooling capacity to meet cooling requirements for the HTS 24.

Figure 2:
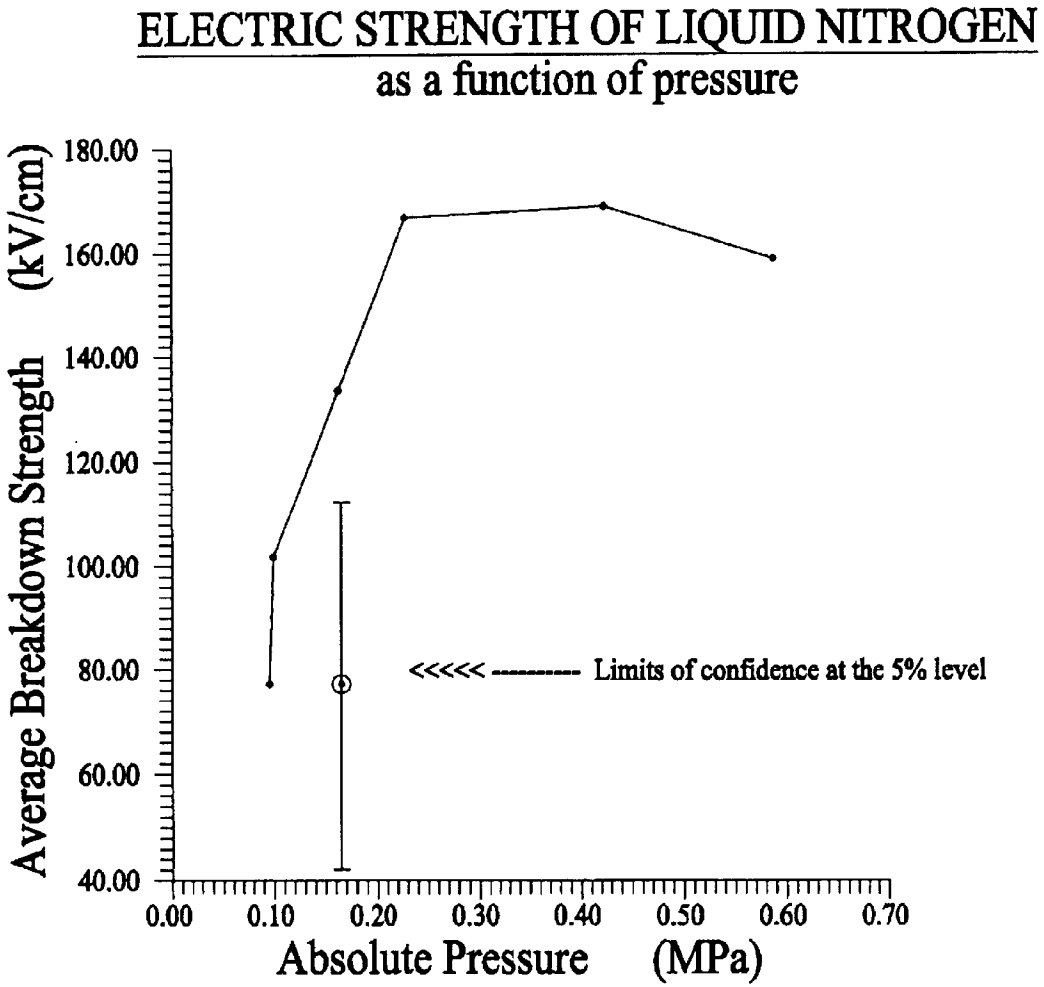
FIG. 2 is a relationship between the dielectric strength of liquid nitrogen and the absolute pressure it is under.

The inner vessel 18 houses cryogen that has a liquid as well as a gaseous region. In one exemplary embodiment the cryogen is nitrogen and is pressurized at 0.3 MPa in order to achieve the optimum dielectric strength of liquid nitrogen per FIG. 2. Bubbles, especially large-size bubbles in the liquid nitrogen could degrade its dielectric strength. Bubble generates when heat generated in HTS 24 causes its temperature to be above the boiling temperature of the liquid nitrogen it submerges in. Increasing the pressure in a cryostat also increases the boiling temperature of the liquid nitrogen. When the nitrogen pressure is maintained at 0.3 MPa, the boiling temperature of liquid nitrogen is elevated to 88K compared to the 77K at 0.1 MPa. This makes the bubble generation more difficult therefore improves the electrical insulation properties of the liquid cryogen. In addition, in order to prevent electric insulation breakdown between HTS 24 and the inner vessel 18, HTS 24 is surrounded by a dielectric medium 38 that acts an electric insulation barrier. Other measures of improving the high-voltage insulation of the cryogenic cooling system include, placing buckets, tubes, boxes or screens or similar objects made from dielectric materials in a meshed configuration to breakdown the size of bubbles if they were generated during the device operation. The cell dimensions of the mesh structure or apertures are selected to be sufficiently small so that any bubbles penetrating the screen will become small enough so that they will not cause substantial degradation of dielectric strength of liquid nitrogen and will not cause any voltage insulation breakdown within HTS 24 and its surrounding environment. In one exemplary embodiment the screen apertures have a diameter in a range up to 5 millimeters.

At 0.3 MPa pressure, the surface temperature at the liquid and gaseous nitrogen boundary 42 is the boiling (saturation) temperature of the boiling liquid nitrogen which is 88K. The liquid nitrogen region is further divided into two regions by a thermal transfer medium 26. The liquid region below the plate 26 is a sub-cooled zone 48 while above the plate 26 is a thermal buffer region 46. The temperature of the sub-cooled region 48 is maintained at about 65K by a cryocooler 20. HTS 24 is submerged in a sub-cooled liquid cryogen region. Because of the lowered operating temperature (65K), the performance of the HTS 24 namely its critical current density level is significantly improved. The cryocooler may be a closed-cycle cryocooler, which is selected from the group including a Gifford-McMahon refrigerator or a pulse-tube refrigerator or a combination of both refrigerator systems.

There will be a temperature transition from 88K at the liquid/gas surface 42, to the 65K at the heat transfer plate 26. There are liquid evaporation and gas condensation process simultaneously occurring along the liquid/gas boundary 42 where an equilibrium state will ultimately form if the HTS device is operating at its steady state and the heat input into the cryostat and cooling by the cryocooler reaches equilibrium. The liquid nitrogen in region 46 could be in a mostly stagnant state or in a turbulent flowing regime depending on the heat load and pattern that exist in this region. The thermal buffer region 46 therefore isolates the sub-cooled region 48 from the events within the region 46.

In this example, the thermal transfer medium 26 is made of copper, which has very good thermal conduction properties and has apertures along its surface (not shown) to facilitate the heat transfer between the two liquid nitrogen regions as well as the heat transfer from these two regions to the cryocooler 20. Even though the thermal transfer plate 26 is not required to achieve the cryogenic cooling system under present invention, its presence will significantly improve the thermal transfer characteristics of such a system. The thermal transfer medium 26 may be a plate, ring, bar or similar configurations, such thermal transfer medium made of copper or similar metal for facilitating transfer of heat from the cryogen regions to the cryocooling means.

In summary, the present invention has several features that more suitable for high-voltage applications while at the same time can improve the performance of the HTS materials. Pressurization of cryogen can put the cryogen at its most optimum dielectric strength while sub-cooling the liquid cryogen region where HTS resides increases the critical current density of the HTS materials.

Next the case is described where liquid cryogen in the thermal buffer region or thermal gradient level (TGL) 46 region of the cryogenic cooling system of present invention is in a mostly stagnant state. Such an environment can exist if the overall heat leak into the TGL is relatively low and there is little or no convective heat transfer taking place within this region. The exemplary embodiment assumes liquid nitrogen as a cooling medium and is pressurized at 0.3 MPa absolute (under which the boiling temperature of liquid nitrogen is about 88K), and the sub-cooled liquid nitrogen region is at about 65K. Again, referring to FIG. 3 for an exemplary system composition. The heat transfer mechanism from the liquid surface 42 to the thermal transfer medium 26 is described as follows. Any heat that flows into gas area 44 will raise the temperature of the gas if it is not immediately transferred out of the gaseous region. At the gas/liquid interface 42, the gas is condensed at the surface of the cryogen. The heat of condensation is then transferred by thermal conduction through TGL 46 to the sub-cooled liquid nitrogen region 48 that is maintained by cryocooler 20. The thickness of TGL 46 and its surface area, defined by copper ring 36, determines the amount of transferable heat through the layer since the upper temperature (88 degrees Kelvin) and lower temperature (65 degrees Kelvin) are effectively set. If the heat input is greater than the set heat conduction value for a certain TGL 46 thickness, the excess heat evaporates the cryogen and reduces the TGL thickness, thus increasing the heat transfer rate until a new equilibrium is reached. If the heat input is less than the heat conduction value through the TGL 46, there will be a net condensation increasing the TGL thickness. The result is that for a certain heat load from the surface 42 to heat transfer medium 26, an optimum equilibrium TGL thickness ($L_{opt}$) will develop. The time dependence of the layer thickness "L" development is given as the TGL increase by condensation minus TGL decrease by evaporation by the heat load "Q", expressed mathematically as:

$dL/dt=k\times(S/L)\times\Delta T\times 1/(S\alpha)-Q/(S\alpha)$, wherein, k=thermal conductivity of the liquid cryogen (for liquid nitrogen, k=1.5 mWatt/cm/Kelvin);

wherein, S=surface area of the TGL ($\pi/4\times 100^2$ $cm^2$ for the case where surface 42 diameter is 100 cm);

wherein, $\Delta T$=temperature difference between upper and lower boundaries of the TGL (88K−65K=23 Kelvin);

and wherein, $\alpha$=latent heat or condensation heat of gas/liquid cryogen (for nitrogen, $\alpha$=162 Joule/$cm^3$).

The optimum thickness of the TGL is realized when $dL/dt=0$ and solving for $L_{opt}$, which gives $L_{opt}=k\times S\times(\Delta T)/Q$.

Figure 5:
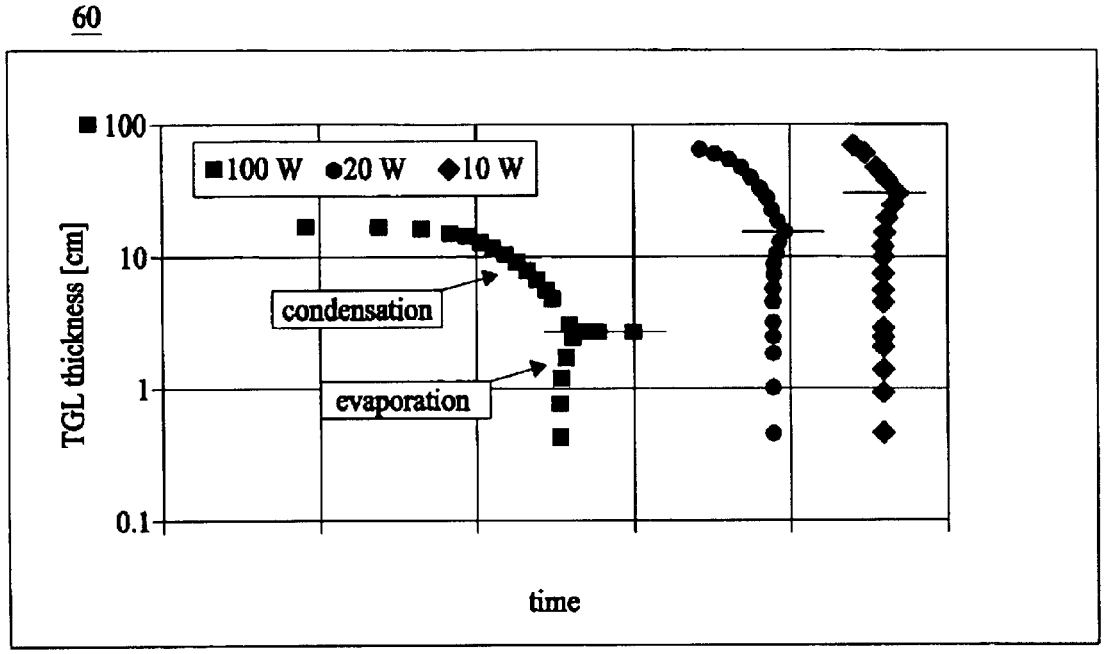
FIG. 5 is a graph showing the thickness of the liquid nitrogen thermal-gradient-layer (TGL) under various heat input loads, for cases where the liquid nitrogen is mostly in a stagnant state.
Figure 6:
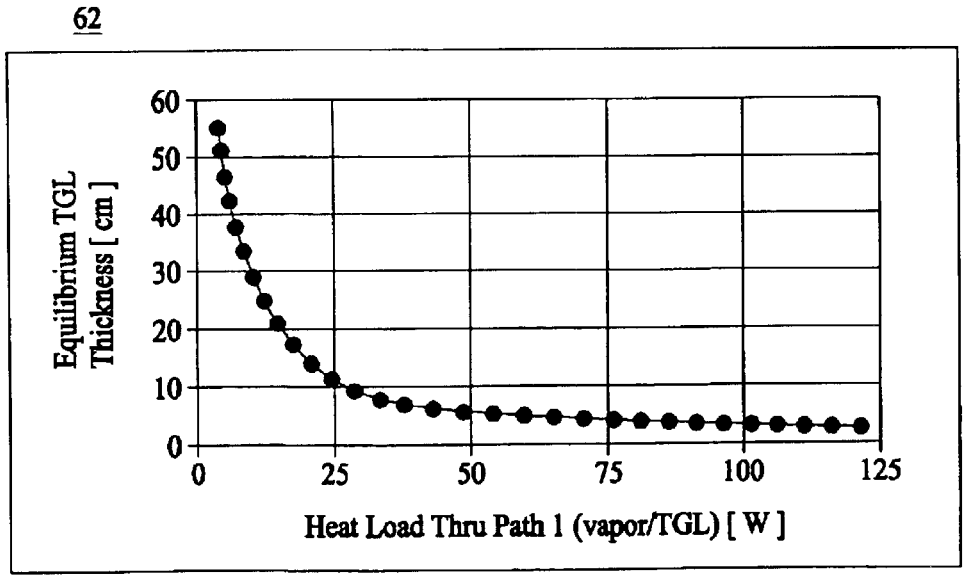
FIG. 6 is a graph showing the relationship of the liquid nitrogen TGL thickness vs. various heat loads in the vapor and TGL regions, for cases where the liquid nitrogen is mostly in a stagnant state.

The graph in FIG. 5 shows calculated data wherein the relationship of the time it takes to reach an equilibrium thickness of the TGL to various heat loads. FIG. 5 illustrates a plot 60 of the time dependent "L" for three different heat loads with $L_{opt}$ indicated at the convergence of the two plots for evaporation and condensation. A plot of $L_{opt}$ verses "Q," graph 62, is shown in FIG. 6, where $L_{opt}$ is the optimal thickness of the TGL and "Q" is the heat load. Note that in these calculations, no additional evaporation heater is included.

The resulting process is a converging self-feedback system. However, for the anticipated operating conditions, the time dependence is very slow resulting in a slow response system. This implies that the parameter controls, such as temperature, pressure and cryogen level are not very sensitive to variation over time. One important result from this analysis is that for the 100-watt case, the optimum TGL thickness is only a few centimeters. The trend of decreased TGL thickness with increasing heat load leads to the conclusion that with increased heat loads, the TGL is getting more sensitive to variation in operating parameters and moves the system into a less stable operating regime.

The previously described embodiments of the present invention have many features including a pressurized cryogen gaseous region and a sub-cooled liquid region, a heating and venting scheme to maintain the pressure, a bubble size control mechanism, and a cooling means that maintains the cryogen at a temperature at or below its boiling point within a sub-cooled temperature range. The characteristics and effects of all these features make the cryogenic cooling system of present invention more advantageous for use in high-voltage HTS applications.

While only certain features of the invention have been illustrated and described herein, many modifications and changes will occur to those skilled in the art. It is, therefore, to be understood that the appended claims are intended to cover all such modifications and changes as fall within the true spirit of the invention. In addition, when describing the present invention, nitrogen, in liquid and gaseous phase, was mentioned as a cryogenic medium. It is also to be understood that other cryogens can be used in place of nitrogen in the cryogenic cooling system of present invention.

What is claimed is:

1. A method for achieving and maintaining cryogenic cooling for a cryogenic cooling system having a cryogen containment vessel that stores cryogen in a liquid state and a gaseous state, wherein the liquid state includes a subcooled region and a thermal gradient layer (TGL) boundary region adjacent the gaseous region and having at least one superconductor, the method comprising the steps of:

maintaining a pressurized cryogen region within the cryogen containment vessel;

maintaining the temperature of the subcooled region of the liquid cryogen at or below its boiling temperature using sub-cooling means; and maintaining an optimum thickness of the TGL, wherein the optimum thickness of such TGL in the case of a stagnat liquid cryogen is expressed by the equation $k \times S \times (\Delta T)/Q$, wherein "S" is the surface area of the TGL, and wherein "ΔT" is the temperature difference across the TGL region, and wherein "k" is the thermal conductivity of the cryogen in the TGL, and wherein "Q" is the heat input to the TGL through the boundary surface between the TGL and the gaseous regions; and maintaining a physical barrier between the TGL and subcooled liquid cryogen regions, wherein such barrier is thermally coupled to a cryocooling means, wherein the thermal conductive characteristics of such barrier allows the heat input "Q" to the TGL to be transferred to the subcooled region and/or the coupled cryocooling means.

2. The method of cryogenic cooling as recited in claim 1, futher comprising the step of maintaining the pressure of the cryogen to above one absolute atomospheric pressure, in order to improve the dielectric strength of the cryogen.

3. The method of cryogenic cooling as recited in claim 1, futher comprising the step of heating and boiling the liquid cryogen in the TGL regrion to increase the pressure of the gaseous cryogen region.

4. The method of cryogenic cooling as recited in claim 1, futher comprising the step of venting gaseous cryogen to reduce the pressure of the gaseous cryogen region.

5. The method of cryogenic cooling recited in claim 1, wherein the cryogen containment vessel is housed in an outer vessel that is adapted to maintain a vacuum between the outer vessel and the inner vessel.

6. The method of cryogenic cooling recited in claim 1, wherein the cryogen containment vessel is housed in an outer vessel that is adapted to maintain a saturated and subcooled liquid cryogen between the outer vessel and the inner vessel, that provides sub-cooling means to the liquid cryogen contained in the inner vessel.

7. The method of cryogenic cooling recited in claim 1, wherein the sub-cooling means is a closed-cycle cryocooler.

8. The method of cryogenic cooling recited in claim 7, wherein the closed-cycle cryocooler is a Gifford-McMahon refrigerator.

9. The method of cryogenic cooling recited in claim 7, wherein the closed-cryocooler is a pulse-tube refrigerator.

10. The method of cryogenic cooling as recited in claim 1, futher comprising the step of maintaining the pressure of the cryogen to raise the boiling point of the cryogen and therefore raising the temperature under which the cryogen generates bubbles.

11. A cyrogenic cooling system having an inner vessel, at least one high temperature superconductor, and an outer vessel, the inner vessel adapted to be contained inside the outer vessel and adapted to store pressurized cryogen in a liquid state and a gaseous state, wherein the liquid state includes a subcooled region and a thermal gradient layer (TGL) boundary region adjacent the gaseous region, the cooling system comprising:

liquid heating means for boiling off liquid cryogen in the TGL region in order to increase the pressure at the gaseous region;

gas venting means for releasing gas in order to reduce the pressure at the gaseous region; and cryogenic cooling means for maintaining a portion of the liquid cryogen in the subcooled region within a sub-cooled temperature range that is at and below its boiling temperature; and thermal gradient layer means for maintaing an optimum thickness of the TGL, wherein the optimum thickness of such TGL in the case of a stagnant liquid cryogen is expressed by the equation $k \times S \times (\Delta T)/Q$, wherein "S" is the surface area of the TGL, and wherein "ΔT" is the temperature difference across the TGL region, and wherein "k" is the thermal conductivity of the cryogen in the TGL, and wherein "Q" is the heat input to the TGL through the boundary surface between the TGL and the gaseous regions;

physical barrier means between the TGL and subcooled liquid cryogen regions, wherein such barrier is thermally coupled to a cryocooling means, wherein the thermal conductive characteristics of such barrier allows the heat input "Q" to the TGL to be transferred to the subcooled region and/or the coupled cryocooling means.

12. The cryogenic cooling system recited in claim 11, wherein the outer vessel is adapted to maintain a vacuum between the inner and outer vessel.

13. The cryogenic cooling system recited in claim 11, wherein the cryogen containment vessel is housed in an outer vessel that is adapted to maintain a saturated and subcooled liquid cryogen between the outer vessel and the inner vessel, that provides sub-cooling means to the liquid cryogen contained in the inner vessel.

14. The cryogenic cooling system recited in claim 11, wherein the cooling means is a closed-cycle cryocooler.

15. The cryogenic cooling system recited in claim 14, wherein the closed-cycle cryocooler is selected from the group including a Gifford-McMahon refrigerator and a pulse tube refrigerator.

16. The cryogenic cooling system recited in claim 11, wherein the physical barrier is in a plate, ring, or bar configuration, such barrier is made of at least one layer of thermally conductive material for facilitating transfer of heat from the TGL liquid cryogen regions to the sub-cooled liquid region and the coupled cryocooling means.

17. The cryogenic cooling system recited in claim 11, further comprising a dielectric medium, wherein the dielectric medium encapsulates the high temperature superconductor.

18. The cryogenic cooling system recited in claim 17, wherein the dielectric medium is a wire mesh, wherein the mesh has apertures no larger than 5 millimeters to facilitate the reduction of the sizes of bubbles in the liquid cryogen regions.

19. A cyrogenic cooling system having an inner vessel, at least one high temperature superconductor, and an-outer vessel, the inner vessel adapted to be contained inside the outer vessel and adapted to store pressurized cryogen in a liquid state and a gaseous state wherein a thermal gradient layer (TGL) is maintained at an optimum thickness, wherein the optimum thickness of such TGL in the case of a stagnant liquid cryogen is expressed by the equation $k \times S \times (\Delta T)/Q$, wherein "S" is the surface area of the TGL, and wherein "$\Delta T$" is the temperature difference across the TGL region, and wherein "k" is the thermal conductivity of the cryogen in the TGL, and wherein "Q" is the heat input to the TGL through the boundary surface between the TGL and the gaseous regions.

20. The cryogenic cooling system recited in claim 19, further comprising a thermal transfer plate disposed inside the inner vessel for coupling thermal heat within the liquid cryogen regions.

21. The cryogenic cooling system recited in claim 19, further comprising cryo-cooling means for maintaining a portion of the liquid cryogen below its boiling point.

22. The cryogenic cooling system recited in claim 19, further comprising a gas evaporation heater disposed inside the inner vessel within the liquid cryogen region.

23. The cryogenic cooling system recited in claim 19, further comprising at least one dielectric bucket encapsulating the superconductor.

24. The cryogenic cooling system recited in claim 19, further comprising multi-layer thermal insulation surrounding the outer surfaces of the inner vessel for reducing the radiation heat leak into the inner vessel.

25. The cryogenic cooling system recited in claim 19, further comprising a bi-metal interface coupled to a thermal transfer plate for facilitating the transfer of heat to the cryo-cooling means.

26. The cryogenic cooling system recited in claim 19, further comprising a vacuum space and corresponding means to maintain the vacuum space, for the interface between the inner vessel and the cryocooling means independent of the vacuum space of the outer vessel and the corresponding means to maintain the vacuum space.

* * * * *